US005735675A

United States Patent [19]

Peoples et al.

[11] Patent Number: 5,735,675

[45] Date of Patent: Apr. 7, 1998

[54] COMBINATION COMPRESSOR UNLOADER

[76] Inventors: Richard Claude Peoples, 265 Old Mill Rd., Grove City, Pa. 16127; Daniel Lee Umbaugh, 24 Northgait Dr., Slippery Rock, Pa. 16057

[21] Appl. No.: 505,521

[22] Filed: Jul. 25, 1995

[51] Int. Cl.[6] ..... F04B 49/02

[52] U.S. Cl. ..... 417/275; 417/314

[58] Field of Search ..... 417/536, 537, 417/238, 314, 275

[56] References Cited

U.S. PATENT DOCUMENTS

| | | | |
|---|---|---|---|
| 136,258 | 2/1873 | Norman | 417/314 |
| 720,112 | 2/1903 | Chase | 417/314 |
| 1,579,782 | 4/1926 | Riesner | 417/314 |
| 1,616,988 | 2/1927 | Redfield | 417/314 |
| 2,127,527 | 8/1938 | Paget | 417/314 |
| 4,068,562 | 1/1978 | Frenkel | 417/275 |
| 4,685,489 | 8/1987 | Yun et al. | 417/274 |
| 4,775,299 | 10/1988 | Overfield et al. | 417/274 |
| 4,838,768 | 6/1989 | Flaherty | 417/314 |
| 5,049,040 | 9/1991 | Diab et al. | 417/274 |
| 5,141,413 | 8/1992 | Bennitt | 417/275 |
| 5,503,537 | 4/1996 | Schlossarczyk et al. | 417/439 |
| 5,564,906 | 10/1996 | Bennitt et al. | 417/238 |

*Primary Examiner*—Timothy Thorpe
*Assistant Examiner*—Peter G. Kurytnyk
*Attorney, Agent, or Firm*—Robert F. I. Conte

[57] ABSTRACT

A combination compressor unloader which has a horizontal cylinder and a double acting piston forming two compression chambers. Each chamber communicates by a passageway with a supplementary chamber with each passageway associated with a reversible actuator having an attached unloader plug capable of sealing the passageway from a remote control. A second means is provided to form a reversible by pass that can deactivate at least one cylinder end of said double ended piston.

9 Claims, 6 Drawing Sheets

COMBINATION COMPRESSOR UNLOADER

This invention contemplates an improved compressor having an integral variable volume unloader. The invention relates to a unique combination unloader device that can be used for both (1)incremental capacity reduction by the addition of volume clearance and (2)for deactivation of a given end of a double acting compressor cylinder.

The unique features of this combination compressor unloader include a removable/replaceable means that allows conversion from/to a volume unloader and from/to a bypass unloader by deactivation of at least one cylinder-end of a double ended piston/cylinder without changing other associated hardware.

This feature will permit the building of standard product compressor cylinders to a standard bill of material and allow relatively simplistic field modification of the unloading scheme to suit the customers application One element making up the volume unloader is a supplementary side chamber having an aperture communicating with one end of the compressor cylinder with the aperture capable of being blocked by a movable pneumatically controlled unloader plug actuator. Opening of the supplementary side chamber provides an increase in cylinder chamber volume.

An additional advantage is that the removable/installable means for field conversion only requires the simple removal or installation of a specialized plug and gasket, removal of this plug opens communication between the inlet or suction side of the gas supply and at least one side of the double sided piston, whereby movement of the piston when the supplementary side chamber aperture is open and the specialized plug is removed results in a free to and fro movement of the gases without compression.

Further advantages can be found in the modifications to the configuration and size of the unloader plug actuator, i.e. control of the size of the plug portion and the head size can be used to control the volume of the supplementary side chamber. Similarly, the volumetric size of any extension of the head end of the combination compressor unloader specialized plug when installed can be controlled to affect the volume of the supplementary side chamber.

Other variations will become apparent from the specification and the detailed drawings attached hereto, wherein similar parts are designated by similar numerals.

DRAWINGS

Figure 9:
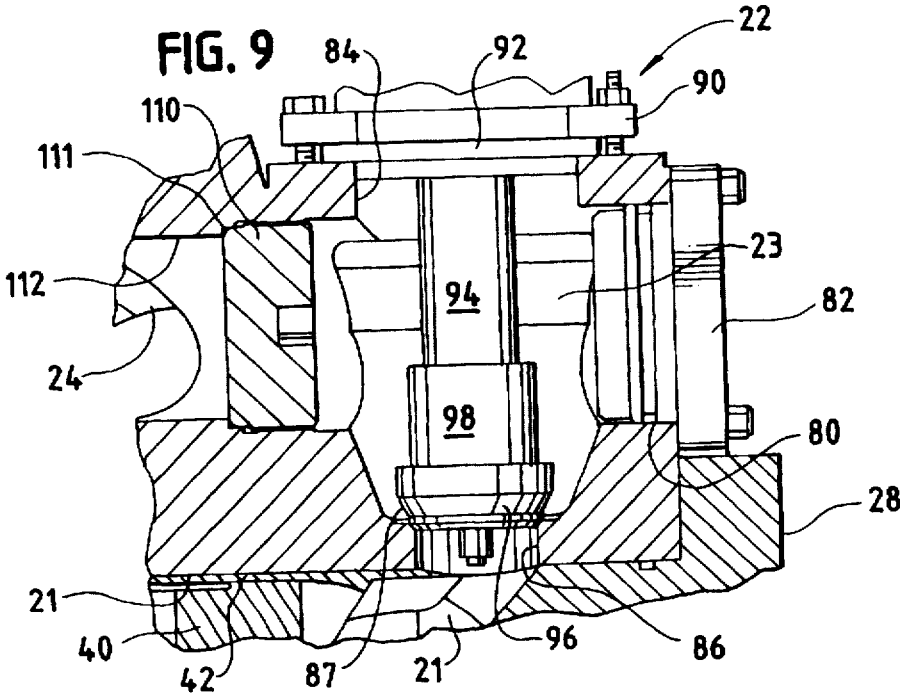
FIG. 9 is a partial elevational view in partial section of a combination unloader with the unloader plug actuator shown schematically in a closed position.
Figure 10:
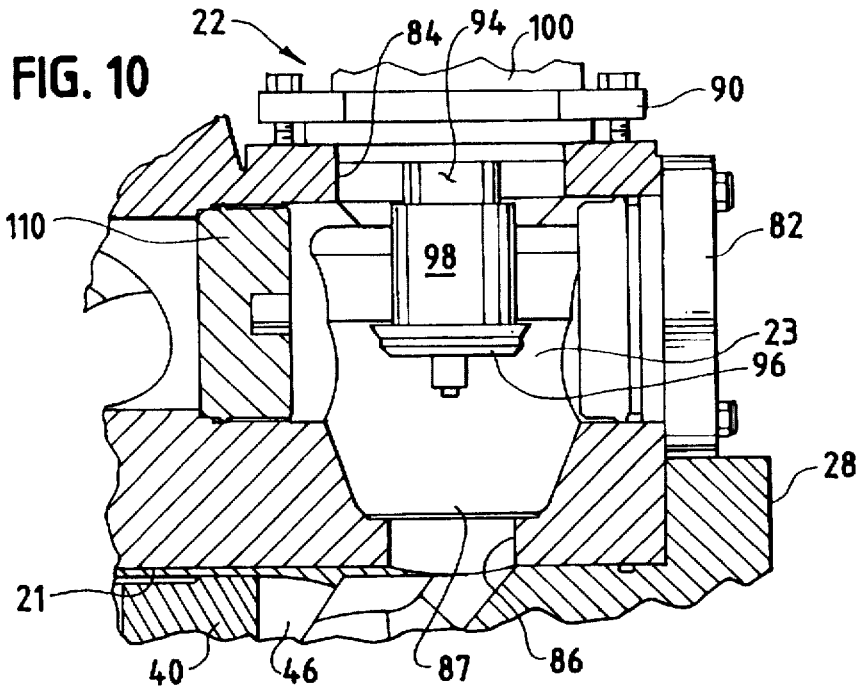
FIG. 10 is similar to FIG. 9 except it shows the unloader plug actuator in retracted position to permit communication between the main compressor cylinder and the supplementary chamber and thereby increase the volume available in the compression stroke of the compressor.
Figure 11:
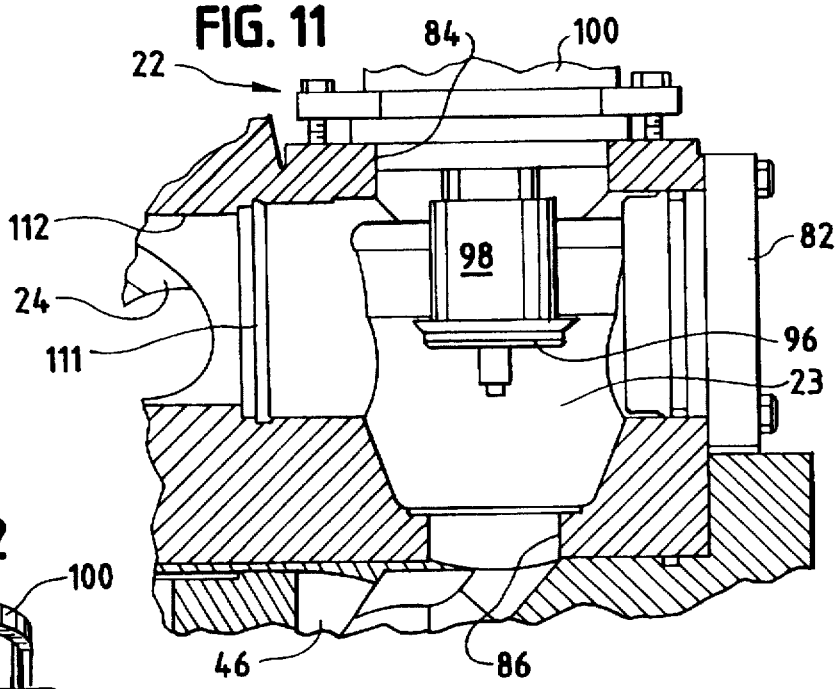
Figure 12:
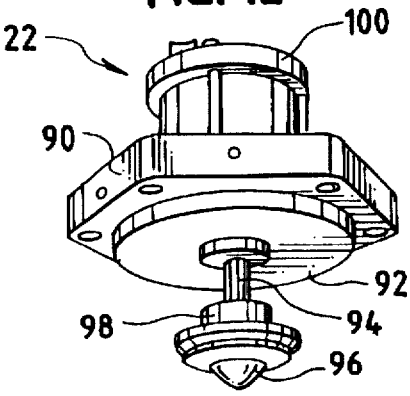

FIG. 11 is similar to FIGS. 9 and 10 except that it shows the unloader plug actuator in retracted position and the removable plug and gasket removed by means of the port on the fight hand side of the supplementary chamber (while the unloader plug actuator is also temporarily removed} (as seen in the drawing). This provides a circuitous open path between the gas inlet and the compressor cylinder whereby movement of the piston merely moves gas back and forth freely between the gas inlet and the compressor cylinder on at least one side of the two sided double acting piston;

FIG. 12 is a perspective view from the underside of the unloader plug actuator in the extended position, this normally is in a spring-loaded retracted position and is in the extended position when air pressure pneumatically forces its plug means into extended sealing position.

Figure 13:
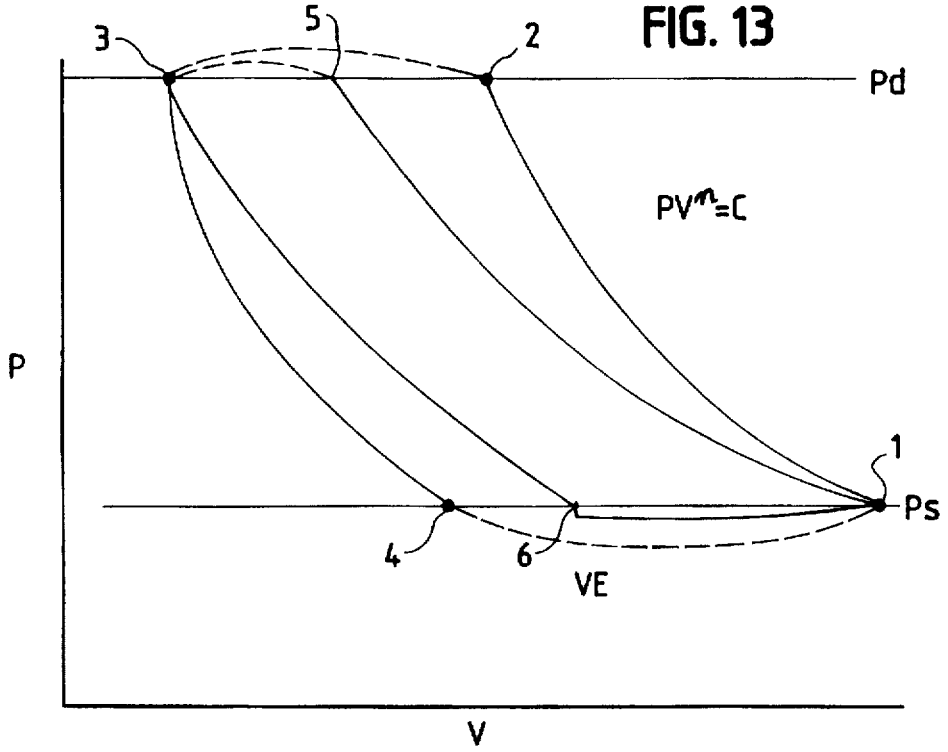
Figure 14:
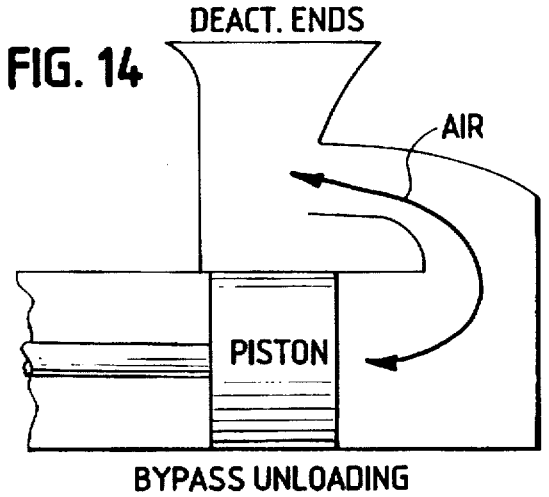
Figure 15:
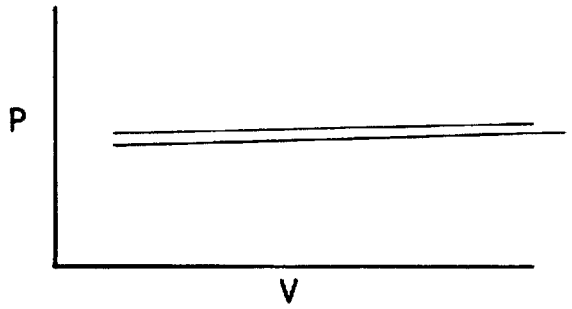

FIG. 13 is a normal pressure/volume chart which is described as being the volumetric efficiency, a ratio of the amount pumped and displacement flowing in the cylinder;

FIG. 14 is a schematic illustration of the free flow of gas in both directions when the bypass unloading plug is removed; and FIG. 15 is a pressure/volume chart showing constant pressure when the bypass unloading plug is removed and the piston moves to and fro.

DETAILED SPECIFICATION

Referring now to the drawings wherein similar parts are designated by similar numerals, the combination compressor unloader includes a double acting piston compressor 20 having two or more unloader plug actuators 22. The compressor 20 is preferably disposed in a horizontal position with the inlet 24 or suction inlet on top and the discharge outlet 26 being disclosed at the lower side.

The front end 28 has a blind pressure head 29 extending into and sealing the front end of the cylinder 21. The opposite or rear end 30 includes a pressure head 31 having a centrally disposed bore 32 and counterbore 34 accommodating sealable beating means 36. These bearing means 36 and bore 32 are adapted to accept and support a reciprocable piston rod 38 for transmission of suitable reciprocating power means.

Figure 8:
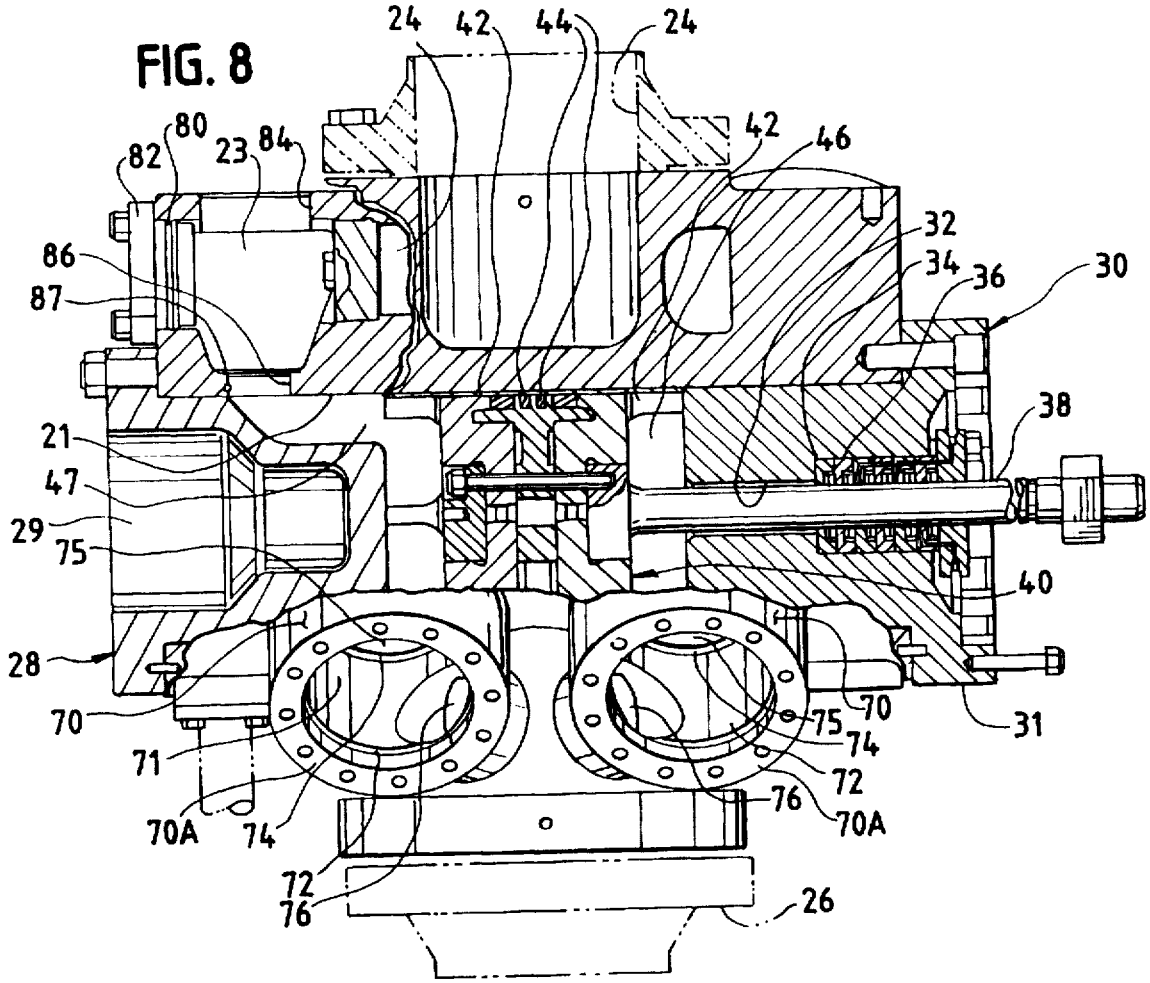
FIG. 8 is a side elevational view in partial section showing the major functional portions of the present invention, absent the unloader plug actuator.

Attached to piston rod 38 is a double faced piston 40. The piston 40 is a multiple piece member utilizing a cylinder liner 42 and normal sealing piston rings 44. The piston 40, as seen in FIG. 8 is in an intermediate neutral position. Normally, during a compressive stroke it would be closer to either head 28 or head 31 and would form small chambers 46 and 47, respectively.

Figure 1:
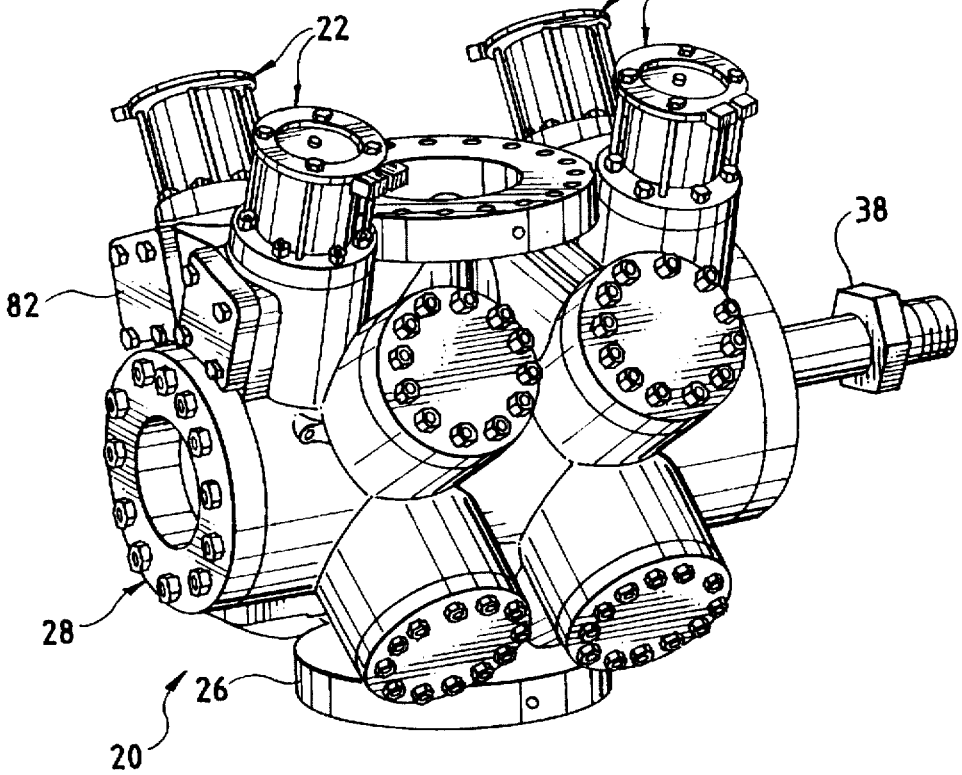
FIG. 1 is a perspective view of a combination compressor unloader of the type contemplated by the present invention.
Figure 2:
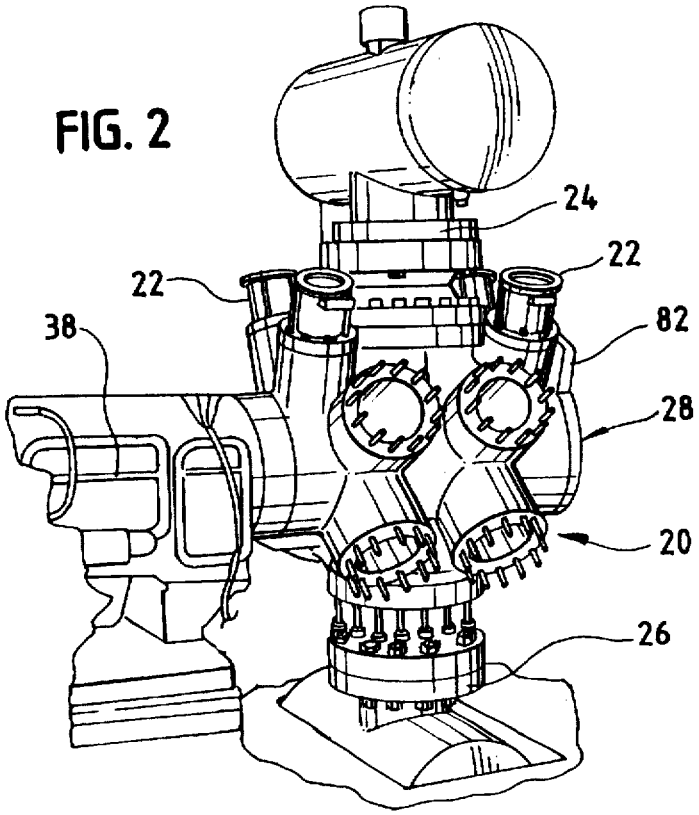
FIG. 2 is a perspective view of the invention shown in FIG. 1 installed and connected to a power source with motion transmission means (with the access ports to the check valves removed for inspection)
Figure 3:
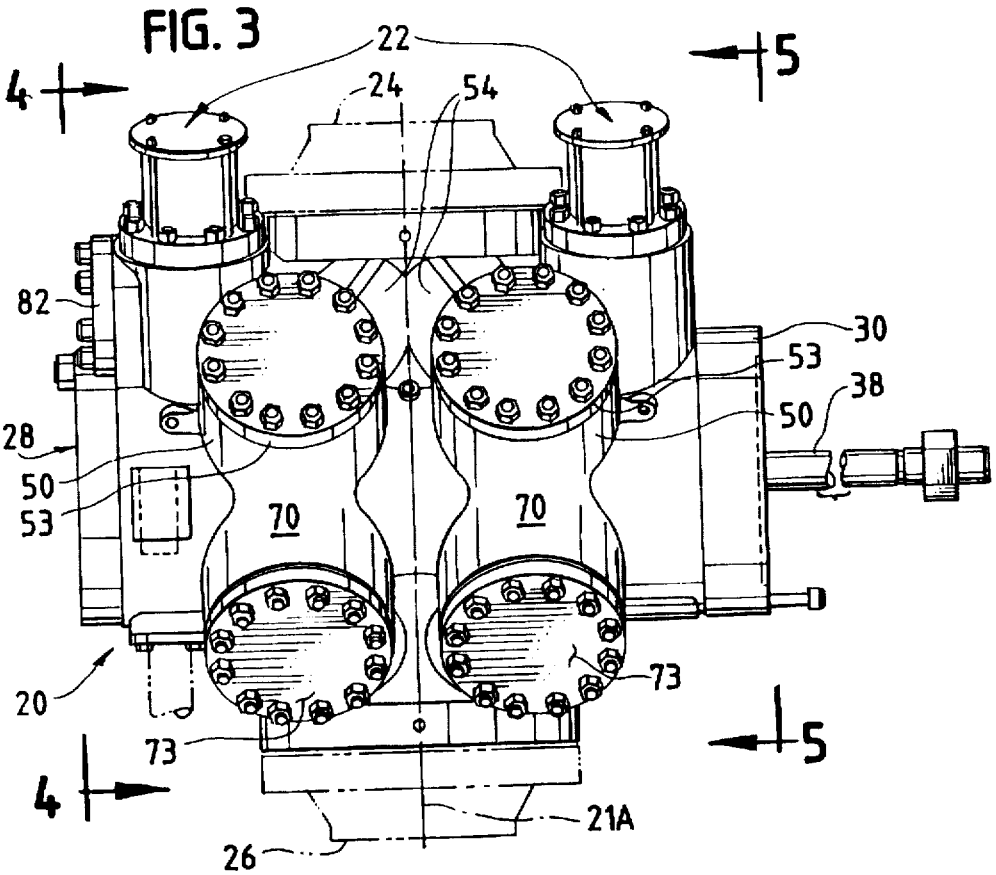
FIG. 3 is a side elevational view of the invention seen in FIG. 1.
Figure 4:
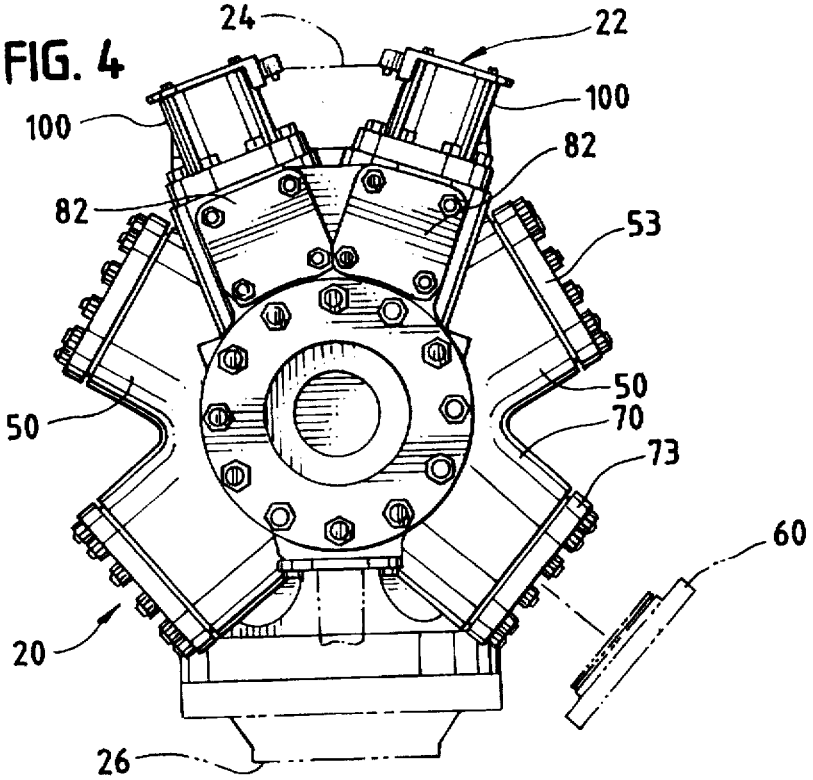
FIG. 4 is a front end elevational view taken along line 4—4 of FIG. 3.
Figure 5:
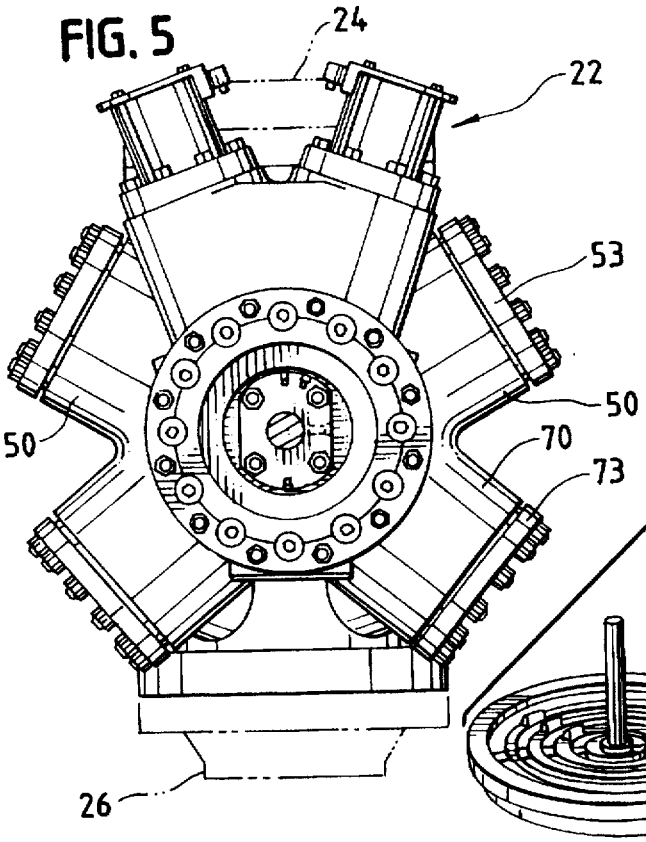
FIG. 5 is a rear end elevational view taken along line 5—5 of FIG. 3.
Figure 6:
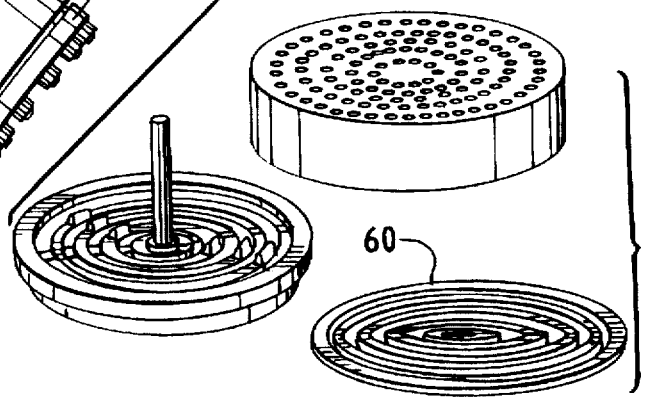
FIG. 6 is an expanded perspective view of the parts of a check valve of the type used in the present invention.
Figure 7:
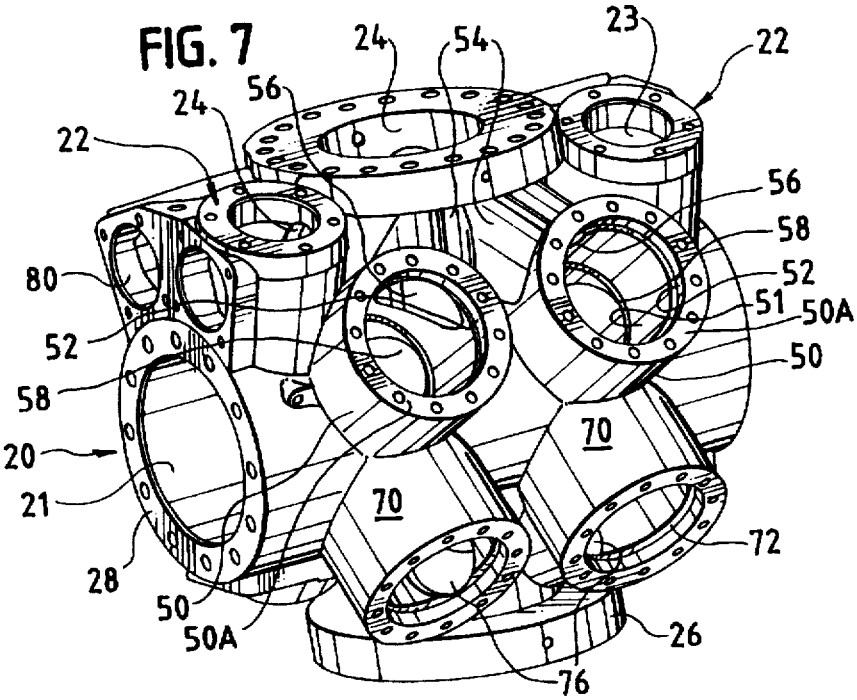
FIG. 7 is a perspective view of the primary body casting of the present invention.

Referring now to FIGS. 1 and 3–6, the main body of the compressor 20 is shown with all of the ports in a sealed condition, while FIGS. 7 and 8 show the basic casting in FIG. 7 without any of the ports covered and without any of the valves in place and in FIG. 8 the partial cross-sections on a variety of planes is for the purpose of understanding the overall operation of the compressor and the invention.

The main body or cylinder 21 supports a pair of angularly disposed generally cylindrical suction inlet members 50 axially spaced on opposite sides of the axial center line 21A of the cylinder 21. Inlet members 50 are hollow and form a substantially cylindrical chamber 51. Each chamber 51 is machined to form and inner sealing surface or seat 52 spaced inwardly from at its outer extremity 50A for mating with the sealing head 53. Each of the chambers 51 includes a lateral passageway 56 extending between the inlet 24 and the interior of chamber 51. Its sidewall is reinforced with appropriate means such as the rib 54.

The inner extremity of each chamber 51 includes a circular seat 58 for accepting the poppet valve 60, of the general variety as shown in FIG. 6 and well known in the art. Seat 58 surrounds the port communicating with the interior of the cylinder. The chambers 51 are diametrally large enough to permit easy replacement of the valves.

Extending angularly downwardly, in the opposite direction from suction members 50, are an equal number of discharge members 70 forming discharge chambers 71 that are provided with an inner seat 72 adjacent its outer end 70A for providing a sealing means for cooperation with the head means 73. A second seat 74 is provided at the opposite inner end and surrounds the egress port 75 from the cylinder and accommodates in mating fashion with the discharge check valves 60, generally of the type shown in FIG. 6. A side wall passage 76 communicates between the chamber 71 and the outlet 26.

Adjacent each end of the compressor 20 there are located a pair of pneumatically and spring operated unloader plug actuators generally designated collectively by the numeral 22. Each unloader plug actuator is positioned juxtaposed a supplementary side chamber 23 opening up and outwardly from the compressor 20 to ambient through a bore 84 and at its lower end communicating through channel 86 with the main cylinder 21 on the compression side of piston 40. The unloader plug actuator 22, as best seen in FIG. 12, includes a head 90, a sealing means 92, an axially reciprocable shaft 94, a radial enlargement 98 extending from shaft 94, and a tapered plug 96 suitably configured to cooperate with the complimentary sealing surface 87 adjoining channel 86.

An actuating means 100 is carried atop head 90 and may include both spring and pneumatic actuating means, not shown, adapted to act upon the reciprocable shaft 94. As a safety feature a positive pressure pneumatic means is utilized to normally keep the plug 96 in sealing relationship with the seat 87. A spring means, not shown, causes the plug 96 to retract, as seen schematically in FIGS. 10–11, when the pneumatic pressure is removed, either intentionally or as the result of a failure in the pneumatic system. Basically, all four of the shown unloader plug actuators 22 generally have the features shown in FIGS. 9–10, except that two supplementary side chambers 23 located at the rear end 30 do not have the axially extending port 80, sealing cover 82, sealing plug 110, nor passageway 112 communicating between supplementary chamber 23 and inlet 24.

When the demand curve for gaseous product drops it is possib le to reduce the P-V product by pneumatically opening the four supplementary chambers 23 by retraction of the plugs 96 and providing communication with the cylinder chambers 46 on opposite sides of the piston 40. Opening these chambers 23 increases the volume for compressible gases. This basically is a volume unloader.

Further control of the volume of the chambers 23 can be controlled by variations in the size of the plugs 96, the diameter and length of the portion of the shaft designated 98, as well as the diameter of the basic shaft 94, to reduce or increase their displacement of the volume of chambers 23. Each of these will affect the volume of compressible gas accommodated in the chamber 23.

In those situations where the desired reduction in volume of gases compressed is substantially greater, this invention will permit a field adjustment not found in other devices of this type. By removing the pressure plates 82 from the front end of the compressor 20 and then removing the pneumatically controlled uploader plug actuators 22 at the front end 28 of the compressor will provide access to the sealing plug 110. Plug 110 can then be removed to provide access through the passageway 112 to the inlet source 24 of gas which will permit a mere to-and-fro movement of gas. Since plugs 110 and their access passages 112 to gas inlet 24 are only located at the front end 28 of the compressor, the unloader plug actuators 22 at the rear end 30 can then be actuated to the closed position, as shown schematically in FIG. 9, thereby only one side of the piston 40 is compressing gas and the actual load is only 50% of the designed total capacity of the two sided piston compressor. This is then known as a by-pass and loader where one side of the compressor is by-passed and the normal total compressor volume is reduced by at least 50%. This is still an efficient method and is schematically displayed in FIGS. 14 and 15.

Referring now to FIG. 13, in a reciprocating compressor if we look at the diagram of the pressure v. the volume, and we are going to compress from suction pressure up to discharge pressure we will start at the inboard position of the piston stroke. Utilizing the encircled numerals of the diagram in FIG. 13, starting at location one (1), where the piston is positioned back from the head providing maximum cylinder volume, the piston is moved forward decreasing the volume and increasing the pressure until it gets to discharge pressure at two (2). Then the gas is pushed across the discharge valves into the discharge line until the piston gets to the end of the stroke at three (3). At this point the piston is at minimum volume, the only volume left in the cylinder is the clearance volume between the piston and the head. Then the direction of the piston is reversed and the volume that is at this clearance volume expands down until it reaches suction pressure at four (4). The suction valve is opened and it takes in the charge of gas and this is the charge that is pumped. This is called the volumetric efficiency, its a ratio of the amount pumped v. displacement flowing in the cylinder. Now, the compression and expansion lines are essentially reversible so that if a fixed clearance is added or subtracted from the cylinder the horsepower is changed, i.e., the area within such closed curve is the horsepower, for example curve 1, 2, 3, 4, as originally described, has a given horsepower, and reduction of the volume of the cylinder results in curve 1, 5, 3, 6. Thus, this results in a change in the horsepower exerted and a change in the amount pumped but essentially it does not result in a change in efficiency because these stay the same since these are still reversible.

Such a change in volume can be carried out by the pneumatically controlled unloader plugs 22 raising the plugs 96 to open the access to the chambers 23 and thereby provide the availability of additional volume. Now, that is one of two ways to unload a cylinder.

The second way of unloading a cylinder is contemplated by the present invention and capable of being field activated without major changes to the compressor. The way contemplated is schematically displayed in FIGS. 11, 14, and 15, and consists of making a passageway in the cylinder normally on the suction side so now suction gas comes in through passageway 112, through chamber 23, out channel 86 and into the cylinder 46 and then pushes right back out, it recirculates therefore no process gas is compressed. You are just pushing it back and forth out of the end having the removable plug 110.

What this compressor does with this unique kind of design, it allows a user to unload, that is add clearance (i.e. volume) by opening the pneumatically controlled unloader plugs 22 to provide access to chambers 23. If this is not adequate then the field adjustment can be instituted to remove the plug 110 and permit immediate ingress and egress of gases on the suction side to at least one side of the piston. This permits the manufacturer to produce a standardized compressor which is capable of adjustment to the customer's needs in a ready simplistic fashion heretofore unavailable to a customer without extensive, expensive, customizing.

Our device is safely operable in that the plug 96 is maintained in the retracted position, as seen in FIGS. 10 and 11, by spring means (not shown) carried in the actuating means 100. A pneumatic means, (also not shown), is positioned within the actuating means 100 and is capable of controlling the downward movement of shaft 94 and plug 96 to sealing engagement with complimentary sealing surface or seat 87. The functions of the spring and the pneumatic means can be reversed, however, an advantage of the arrangement initially described above is that the plug 96 is out unless you put pressure to the unloader. If you lose your control pressure you will get minimum horsepower. With this type of actuation where it takes controlled air pressure to seal the plug it is actually a safety device because if you lose controlled air pressure you're going to go to the unloading condition. The plug is going to retract, open up the passage and you'll have less load on the unit.

When the controlled air pressure is operating properly the acuator 100 can contain an inlet, an outlet and a control unit that may be connected to a remote micro-process control that can be a long distance from the compressor and still operate it at the chosen configuration.

We claim:

1. A combination compressor unloader having a double ended double acting piston and cylinder, said compressor including first means for incremental variable capacity reduction by utilization of remotely controllable means capable of adding a predetermined amount of volume clearance, and further including second means for deactivation of at least one end of said cylinder, characterized in that said first means being reversibly moveable thereby permitting reversible conversion to and from a volume unloader and said second means forming a reversible bypass that can deactivate at least one cylinder end of said double ended piston and cylinder.

2. A combination compressor unloader as claimed in claim 1, wherein each said first means includes a supplementary side chamber and passage means communicating with one end of said compressor cylinder, a movable unloader plug in each said passage means capable of blocking its associated passage means.

3. A combination compressor unloader as claimed in claim 2, wherein a pneumatically controlled actuator is connected to each unloader plug.

4. A combination compressor unloader as claimed in claim 3, wherein said controlled actuator includes spring means to normally keep said unloader plug in a retracted position with said passage means between said supplementary chamber means and said cylinder chamber being normally open; said unloader plug being maintained in a closed sealing condition by said actuator's pneumatic controls, failure of said pneumatic control results in said spring means opening said unloader plug and thereby acting as a safety means.

5. A combination compressor unloader wherein said compressor includes a horizontal cylinder, a double acting piston, a blind head at the first end of said cylinder, a sealing bearing head at the second end of said cylinder, a piston rod connected at one end to said piston, passing through said bearing seal and connected to a power source at said rod's opposite end, said double ended piston forming two compression chambers between itself and said blind and sealing heads at opposite ends within said cylinder, at least one suction inlet into each compression chamber and at least one discharge port extending away from each compression chamber, at least one supplementary side chamber communicating by a passageway with each compression chamber, and said at least one supplementary side chamber including an actuator with an attached unloader plug capable of sealing said communicating passageway.

6. A combination compressor unloader as claimed in claim 5 wherein each said compression chamber is connected to a pair of said suction inlets and a pair of said discharge ports extending angularly in opposite directions from opposite first and second end portions of said cylinder body, all of said suction inlets connected to a common main suction line and all of said discharge ports being connected to a common main compressed line, each said compression chamber being connected to a said passageway to at least one second supplementary chamber having a said unloader plug and a said actuator.

7. A combination compressor unloader as claimed in claim 6, wherein each said compression chamber includes two supplementary chambers each connected to the said compression chamber by one of a pair of said passageways, each said supplementary chamber including an independent one of said unloader plug and associated actuator.

8. A combination compressor unloader as claimed in claim 7, wherein a port co-axially disposed relative to said cylinder and a removable sealing cover plate provide lateral access into at least one of said supplementary chambers positioned adjacent to said blind head at one end of said cylinder, a pathway providing communication between said at least one supplementary chamber and said main suction line and coaxial with said sealing cover plate whereby when said unloader plug and actuator are in an open disposition the material flowing through said main suction line is free to move to-and-fro into and out of the compression chamber to which they are attached without any substantial change in compression pressure.

9. A unique combination compressor unloader as claimed in claim 8, wherein said pathway includes an intermediate seat means adapted to accept a specialized sealing plug that is accessible through said co-axially disposed sealing cover plate adapted for removal or insertion when said unloader plug and said actuator for that at least one supplementary chamber are axially displaced to permit ready unobstructed access through said sealing cover plate.

* * * * *